US007000680B2

(12) United States Patent
Kurokawa et al.

(10) Patent No.: US 7,000,680 B2
(45) Date of Patent: Feb. 21, 2006

(54) CASTING MOLD AND METHOD FOR MANUFACTURING THE SAME

(75) Inventors: Yutaka Kurokawa, Hiroshima (JP); Hideo Une, Hiroshima (JP); Yuji Hori, Hiroshima (JP); Shoichi Nishi, Hiroshima (JP); Hiroaki Kusunoki, Hiroshima (JP); Naohiro Miura, Hiroshima (JP)

(73) Assignees: Tsuchiyoshi Industry Co., Ltd., Hiroshima (JP); Mazda Motor Corporation, Hiroshima (JP)

( * ) Notice: Subject to any disclaimer, the term of this patent is extended or adjusted under 35 U.S.C. 154(b) by 0 days.

(21) Appl. No.: 11/053,051

(22) Filed: Feb. 8, 2005

(65) Prior Publication Data

US 2005/0178522 A1 Aug. 18, 2005

(30) Foreign Application Priority Data

Feb. 12, 2004 (JP) ..... 2004-035631

(51) Int. Cl.
*B22C 1/18* (2006.01)

(52) U.S. Cl. ..... 164/528; 164/527

(58) Field of Classification Search ..... 164/527, 164/528

See application file for complete search history.

(56) References Cited

U.S. PATENT DOCUMENTS

2004/0050524 A1 * 3/2004 Grassi et al. ..... 164/131

FOREIGN PATENT DOCUMENTS

JP 53-119724 A 10/1978
JP 11-285777 10/1999

* cited by examiner

*Primary Examiner*—Kuang Y. Lin
(74) *Attorney, Agent, or Firm*—Brooks Kushman P.C.

(57) ABSTRACT

A casting mold which is molded by heating mulled sand including a mixture of refractory molding sand particles, an inorganic water soluble binder and water, wherein the inorganic water soluble binder is made of a combination of a sulfate compound such as magnesium sulfate heptahydrate and a borate compound such as sodium tetraborate decahydrate. The casting mold is formed by baking the mulled sand in such a manner that at least part of the sulfate compound retains water of crystallization therein and the borate compound is once fused and then cured.

7 Claims, 8 Drawing Sheets

CASTING MOLD AND METHOD FOR MANUFACTURING THE SAME

CROSS-REFERENCE TO RELATED APPLICATION

This application claims priority under 35 U.S.C. §119(a) to Japanese Patent Application No. 2004-35631, the entire contents of which are hereby incorporated by reference.

BACKGROUND OF THE INVENTION (a) Field of the Invention

The present invention relates to a casting mold including an inorganic water soluble binder and a method for manufacturing the same.

(b) Description of Related Art

It has been commonly known that inorganic water soluble binders such as sulfate compounds are used for forming molds of refractory molding sand particles and the binders are collected for reuse by dissolving the molds in water after the manufacture of castings using the molds. Among the sulfate compounds, an inorganic binder based on magnesium sulfate is used with growing frequency in recent days because the binder can be used repeatedly for the manufacture of aluminum alloy castings and does not generate toxic gases that cause environmental pollution. This tendency is derived from that magnesium sulfate has a melting point of 1185° C. and therefore does not cause decomposition or deterioration of the mold during the manufacture of the aluminum alloy castings.

For example, Japanese Unexamined Patent Publication No. SHO53-119724 describes use of magnesium sulfate heptahydrate as the inorganic water soluble binder. The publication describes that mulled sand made of refractory particles covered with magnesium sulfate heptahydrate is molded and dried at a temperature not lower than 200° C. to obtain a mold. Further, Japanese Unexamined Patent Publication No. HEI11-285777 describes that a mixture of refractory particles, water and a binder made of calcium sulfate and magnesium sulfate is packed in a forming die and heated at 350° C. for 4 hours to obtain a mold.

However, when the above-described magnesium sulfate hydrate is heated to a temperature of 200° C. or higher as described in Japanese Unexamined Patent Publication No. SHO53-119724, the magnesium sulfate loses water of crystallization and turns into magnesium sulfate anhydride. This brings inconvenience in keeping the strength of the resulting mold. According to the inventor's researches, magnesium sulfate in the form of trihydrate or tetrahydrate gives high strength to the resulting mold, but the strength decreases significantly if magnesium sulfate becomes an anhydride. Japanese Unexamined Patent Publication No. HEI11-285777 also describes that a test piece in which magnesium sulfate is used alone as the binder shows a bending strength as low as 0.04 kg/mm$^2$ when heated at 350° C. for 4 hours.

Accordingly, in order to retain the mold strength to a sufficient degree, a huge amount of magnesium sulfate is required. However, this is disadvantageous in shaping and baking of the mold or collection of the binder, resulting in low work efficiency.

Japanese Unexamined Patent Publication No. HEI 11-285777 describes that the combined use of magnesium sulfate and calcium sulfate improves the mold strength. However, calcium sulfate is not suitably used in a water soluble mold because it has low solubility in water.

In contrast to this, the inventor of the present invention has succeeded in baking a mold of high strength such that a certain amount of water of crystallization remains in magnesium sulfate.

In terms of environmental loads and synchronization with casting cycle time, curing in as short time as possible, i.e., fast curing, is required. However, in use of a binder which is based on magnesium sulfate and will be cured by heating, energy for evaporating moisture and raising the temperature of the mold is required, thereby taking long curing time in general. The curing time varies depending on the weight of the intended mold and the molding conditions, but in most cases, the curing time required is about 1 minute for a mold having a mass of about 1 kg, and 5 minutes or longer for a mold having a mass of about 10 kg.

Since magnesium sulfate changes its hydration number depending on temperature, it is necessary to keep every part of the mold at a specified temperature to bake the mold in which magnesium sulfate retains a specified amount of water of crystallization. Accordingly, a longer baking time is required, causing a significant decrease in productivity.

To cope with the above problem, there are known techniques of baking the mold with a microwave or high frequency wave. Such techniques are advantageous in that substances contained in the mold are directly heated to uniform the mold temperature in every part of the mold. However, since the inorganic water soluble binder contains a large amount of moisture and water of crystallization, it takes a long time to raise the mold temperature to 100° C. or higher due to latent heat by moisture vaporization. Moreover, since the heat of the binder is taken by the refractory particles which cannot be heated by the microwave, a temperature difference may be caused within the binder. Therefore, there is difficulty in obtaining a mold of uniform strength.

Further, there are other known techniques of heating a forming die in advance and packing the mulled sand therein to bake the mulled sand with heat transferred from the forming die. According to such techniques, to raise the temperature of the mold making material to a specified temperature higher than 100° C., for example, the forming die is heated to a temperature higher than the specified temperature. However, in this case, the temperature of the surface of the mold making material contacting the forming die exceeds the specified temperature in a short time, but the temperature of the inner part of the mold making material does not rise smoothly, causing a temperature difference between the surface and the inside of the mold making material. Accordingly, if the heating temperature and heating time are controlled such that the surface temperature of the mold making material reaches the specified temperature, the hydration number of the sulfate compound in the inner part of the mold making material remains high. On the other hand, if the heating temperature and heating time are controlled such that the temperature of the inner part of the mold making material reaches the specified temperature, the sulfate compound in the surface part of the mold making material decreases the hydration number or loses the hydration number to become an anhydride. Thus, the hydration number of the obtained mold varies by part and a uniform strength cannot be given to the mold. Therefore, it is necessary to bake the mold making material at low temperatures for a long time to equalize the hydration number in every part of the mold, and thereby giving the uniform strength to the mold.

SUMMARY OF THE INVENTION

An object of the present invention is to obtain a mold which cures quickly and has the same strength in every part even with use of a sulfate compound such as magnesium sulfate as a binder. Another object of the present invention is to improve a filling property of the mulled sand and to allow easy release of the mold from the forming die.

According to the present invention, the above objects are achieved by combining a sulfate compound containing water of crystallization and a borate compound which is fused at relatively low temperatures and cured by cooling to prepare an inorganic water soluble binder.

That is, the present invention provides a casting mold which is molded by heating mulled sand including a mixture of refractory molding sand particles, an inorganic water soluble binder and water in a forming die, wherein the inorganic water soluble binder contains a sulfate compound and a borate compound, at least part of the sulfate compound retains water of crystallization therein after the heating and the borate compound is once fused by the heating and then cured.

The inorganic sulfate compound containing water of crystallization gives different strengths to the mold depending on its hydration number. If the compound becomes an anhydride, the strength is not given to the mold. According to the present invention, the binder is cured with at least part of the sulfate compound retaining water of crystallization. Therefore, the strength of the mold increases. However, as described above, the hydration number of the sulfate compound, i.e., the mold strength given by the sulfate compound, varies depending on the heating temperature. Therefore, if the temperature of the mold varies by part during baking, the strength of the mold also varies by part.

In the present invention, however, the borate compound is once fused by the heating and then cured by cooling, thereby giving the strength to the mold. Accordingly, if the heating temperature is raised to speed up the curing of the mold and therefore the hydration number of the sulfate compound varies to partially decrease the mold strength, the loss of the strength is supplemented by the borate compound, whereby the mold strength becomes uniform in every part.

That is, when the mold temperature after the baking is high, the mold strength is ensured by the sulfate compound, and therefore the mold can be released while the mold temperature is high. Further, the borate compound is fused at relatively low temperatures during the baking and gives the strength to the mold after cooling the mold, thereby giving a fast curing property to the mold. Both of the sulfate compound and the borate compound contribute to the strength of the cooled mold.

Moreover, the borate compound contained in the binder facilitates the release of the mold after the baking. If the sulfate compound is used alone, the mold strength is given by heating and therefore the mold adheres to the forming die, which makes the release of the mold difficult. On the other hand, if the borate compound is added, the borate compound in contact with the forming die is fused while the temperature of the forming die is high, thereby weakening the adhesion between the mold and the forming die and allowing easy release of the mold.

As described above, according to the present invention, the borate compound compensates the variations in strength caused by the sulfate compound, thereby ensuring the mold strength. Therefore, the temperature for heating the mold can be set higher and the heating time is reduced. Further, the borate compound allows easy release of the mold, thereby increasing productivity. Thus, a water soluble mold is obtained with excellent strength.

The inorganic water soluble binder mentioned herein does not signify that every constituents of the binder has water solubility, but requires that at least part of the constituents has water solubility so that the mold dissolves in water after the manufacture of castings using the mold.

The borate compound is preferably one or a combination of two or more of sodium tetraborate, sodium metaborate, dipotassium tetraborate, ammonium borate, boric acid, magnesium borate, lithium tetraborate, aluminum tetraborate and manganese borate. Sodium tetraborate is preferably a decahydrate or an anhydride. Sodium metaborate, dipotassium tetraborate and ammonium borate are preferably tetrahydrates. Lithium tetraborate is preferably pentahydrate and manganese borate is preferably octahydrate.

The content of the borate compound in the inorganic water soluble binder is preferably 75 mass % or less. If the content of the borate compound which is fused at low temperatures is high, the mold strength becomes insufficient while the mold temperature after the baking is high and therefore the mold cannot be released from the forming die. Further, when the content of the borate compound is high, the solubility of the borate compound in water becomes too low to prepare the mulled sand easily. Moreover, the obtained mold is not easily dissolved in water after the manufacture of the castings, which is disadvantageous in separation and collection of the binder for reuse. For the above reasons, the content of the borate compound is preferably 75 mass % or less. The content of the borate compound is preferably 0.5 mass % or more, more preferably 1 mass % or more.

In the case of combining the borate compounds one by one with the sulfate compound, sodium metaborate tetrahydrate is preferably used in an amount of 50 mass % or less, dipotassium tetraborate tetrahydrate is preferably used in an amount of 75 mass % or less, and sodium tetraborate decahydrate, sodium tetraborate anhydride, ammonium borate tetrahydrate, boric acid, magnesium borate, lithium tetraborate pentahydrate, aluminum borate and manganese borate octahydrate are preferably used in an amount of 60 mass % or less.

It is preferable that the sulfate compound is at least one of magnesium sulfate, aluminum sulfate and sodium sulfate and decomposed at a temperature of 750° C. or higher. Particularly preferable one is magnesium sulfate.

Magnesium sulfate becomes a rigid and stable crystal when the hydration number thereof is 3 to 4, thereby ensuring the strength of the mold. Since magnesium sulfate anhydride has a melting point of 1185° C., it does not decompose or deteriorate during the manufacture of aluminum alloy castings. Further, magnesium sulfate is advantageously reused after the manufacture of the castings due to its high solubility in water.

Like magnesium sulfate, aluminum sulfate and sodium sulfate are also effective binders. However, they are particularly effective when combined with magnesium sulfate. Magnesium sulfate trihydrate or tetrahydrate tends to become a heptahydrate having low strength when it absorbs moisture. On the other hand, aluminum sulfate is able to become a crystal of high hydration number and sodium sulfate is highly capable of absorbing moisture. Thus, both of them can prevent magnesium sulfate from deterioration by the moisture absorption.

Further, magnesium sulfate, aluminum sulfate and sodium sulfate reach the hydration numbers which give a peak strength to the mold at different temperatures. Therefore, if the different sulfate compounds are used in combination, the lack of mold strength derived from one compound can be covered by the other compound. For example, in part of the mold, even if one of the sulfate compounds does not reach the hydration number which gives the peak strength due to variations in temperature of the mulled sand during the baking, other sulfate compound contained therein reaches the hydration number which gives the peak strength. As a result, uniform strength is obtained in every part of the mold.

With a view to preventing the deterioration of the sulfate compound during the manufacture of castings, the decomposition temperature of the sulfate compound is preferably 750° C.

It is preferable that the inorganic water soluble binder further contains at least one of sodium dihydrogen phosphate, potassium dihydrogen phosphate, tricalcium phosphate and magnesium chloride.

Sodium dihydrogen phosphate becomes highly rigid after cooling, which advantageously improves the mold strength. In particular, the mold is locally heated when molten metal is poured therein, whereby the sulfate compound in that part may become an anhydride having low strength. However, sodium dihydrogen phosphate prevents a significant decrease in mold strength derived from the conversion of the sulfate compound into the anhydride. That is, the mold is given with high resistance to heat. However, the content of sodium dihydrogen phosphate is preferably limited to 10 mass % or less of the content of magnesium sulfate because sodium dihydrogen phosphate is insoluble in water at high temperatures, tends to adhere to the refractory particles by vitrification, and causes deliquescence that may lead to the mold deterioration by the moisture absorption.

Like sodium dihydrogen phosphate, potassium dihydrogen phosphate also becomes highly rigid after cooling and therefore improves the strength and the heat resistance of the mold. However, because of the same problems as those associated with sodium dihydrogen phosphate, the content of potassium dihydrogen phosphate is preferably limited to 10 mass % or less of the content of magnesium sulfate.

Tricalcium phosphate is gradually hydrated in the presence of moisture and cured as $[Ca_3(PO_4)_2]_3Ca(OH)_2$. Therefore, it advantageously prevents the deterioration of the mold by the moisture absorption and improves the heat resistance of the mold. Further, magnesium chloride has the effect of improving the fast curing property and heat resistance of the mold.

The present invention further provides a method for manufacturing a casting mold using mulled sand including a mixture of an inorganic water soluble binder containing a sulfate compound and a borate compound, water and refractory molding sand particles, the method comprising the steps of: filling a forming die with the mulled sand; and heating the mulled sand in the forming die in such a manner that at least part of the sulfate compound retains water of crystallization therein and the borate compound is fused.

According to the present invention, at least part of the sulfate compound retains water of crystallization to give strength to the mold and the borate compound is once fused and then cured by cooling to give strength to the mold. Therefore, even if part of the mold lacks the strength due to the variations in hydration number in the sulfate compound, the lack of the strength is supplemented by the borate compound. Therefore, the heating temperature can be raised to cure the mold quickly and the mold strength becomes uniform in every part of the mold.

Further, the fused borate compound improves heat conduction of the mold, i.e., heat is easily transferred to every part of the mold. Therefore, the mold is cured quickly, the variations in hydration number in the sulfate compound are prevented, and therefore the mold is given with strength which is uniform in every part of the mold. Further, since the sulfate compound ensures the mold strength while the mold temperature is high, the mold can be released from the forming die at high temperatures. At this time, the borate compound contacting the forming die is in the fused state, thereby allowing easy release of the mold.

It is preferable that the forming die is kept at a specified temperature and filled with the mulled sand to heat the mulled sand by heat transferred from the forming die. This allows fast heating of the mulled sand in the forming die up to the predetermined temperature. Further, when the forming die is filled with the mulled sand, the borate compound in contact with the forming die is fused, thereby increasing the flowability of the mulled sand. Thus, every part of the forming die can be filled with the mulled sand at high density.

DETAILED DESCRIPTION OF THE INVENTION

Hereinafter, a detailed explanation is given of an embodiment of the present invention with reference to the drawings.

In this embodiment, the present invention is applied to a casting mold for manufacturing aluminum alloy castings and a method for manufacturing the same. First, a molding machine is described.

(Molding Machine)

Figure 1:
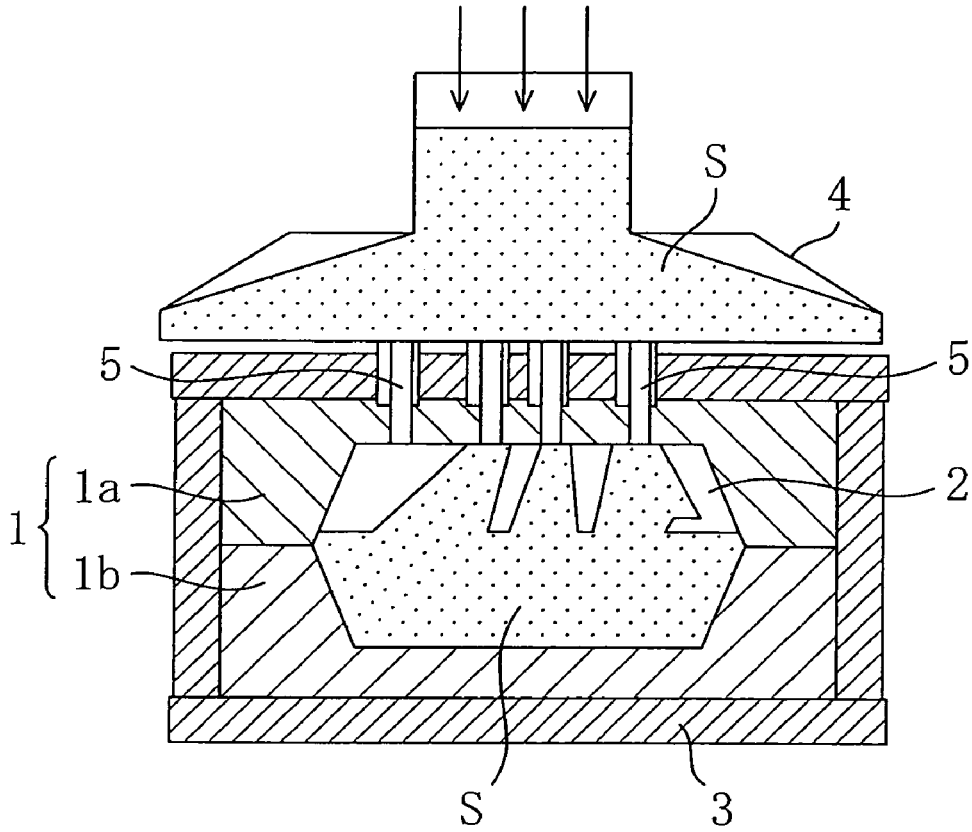
FIG. 1 is a sectional view illustrating a warm shot molding machine.

In a molding machine shown in FIG. 1 (hereinafter referred to as a warm shot molding machine), a forming die (mold) 1 is heated to a specified temperature in advance and a cavity 2 of the forming die is filled with mulled sand S. The cavity 2 is formed by an upper die 1*a* and a lower die 1*b*. The forming die 1 made up of the upper and lower dies 1*a* and 1*b* is contained in a casing 3. A blow head 4 is arranged on the casing 3. Compressed air is applied from the blow head 4 to blow the mulled sand S from a blow nozzle 5 into the cavity 2 so that the mulled sand S is introduced under pressure. The mulled sand S in the forming die 1 is baked by heat transferred from the forming die 1. Water vapor generated from the mulled sand S during the heating is removed from the cavity 2 by an air purge means (not shown in FIG. 1, but made up of components 8–10 shown in FIG. 2).

Figure 2:
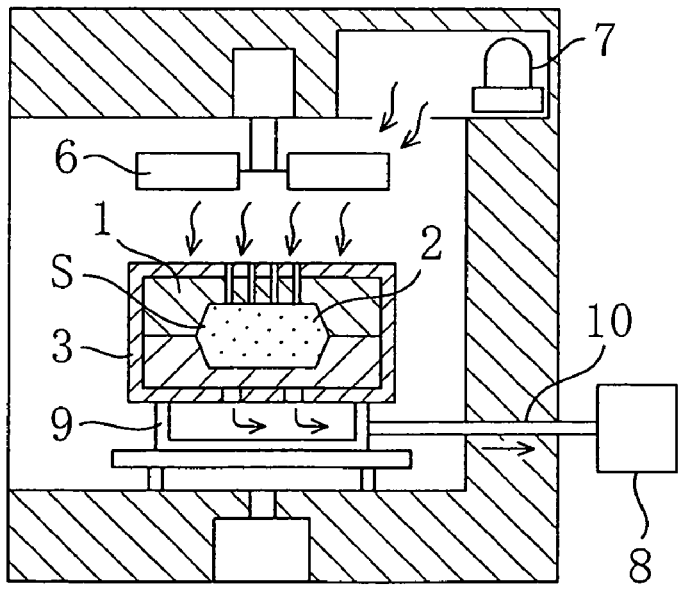
FIG. 2 is a sectional view illustrating a molding machine of microwave irradiation heating system.

In a molding machine shown in FIG. 2, the mulled sand S is heated and baked by microwave irradiation to obtain a mold. A forming die 1 (including an upper die 1*a* and a lower die 1*b*) is made of ceramic. After the mulled sand S is packed in a cavity 2, in a microwave irradiation chamber, the forming die 1 is irradiated with a microwave from a magnetron 7 while a stirrer 6 installed above the forming die 1 is rotated. The microwave passes through the forming die 1 to act on the mulled sand S in the cavity 2. Water vapor generated is removed to the outside by a suction pump 8 via a suction hood 9 and a suction hose 10.

Figure 3:
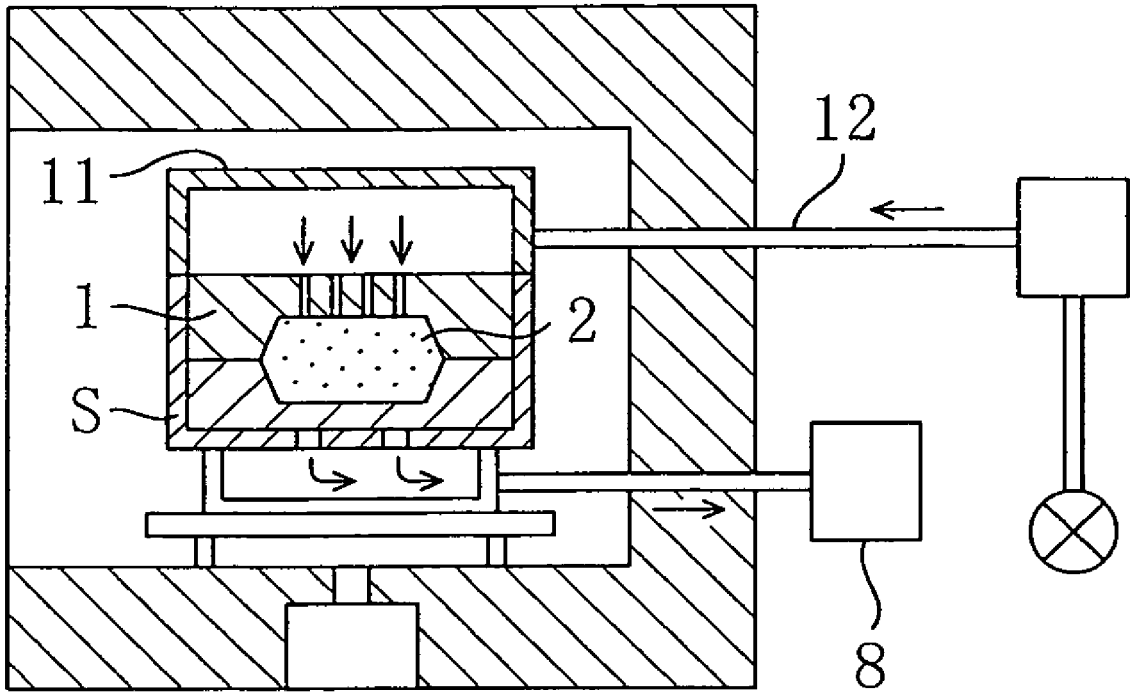
FIG. 3 is a sectional view illustrating a molding machine of hot air heating system.

In a molding machine shown in FIG. 3, the mulled sand S is heated and baked by hot air to obtain a mold. An air hood 11 is arranged above a forming die 1 and hot air sent through an air hose 12 is supplied to the cavity 2 via the air hood 11 to heat the mulled sand S. Water vapor generated is removed to the outside by a suction pump 8 via a suction hood 9 and a suction hose 10.

(Mulled Sand)

The mulled sand S is made of a mixture of molding sand (refractory particles), an inorganic water soluble binder and water. Each of the molding sand particles is covered with the inorganic water soluble binder.

Any kind of molding sand may be used as long as it is generally used as refractory molding sand particles and has an average particle size of about 0.05 mm (280 mesh) to 1 mm (16 mesh). Examples thereof include silica sand of domestic origin, imported silica sand, zircon sand, chromite sand, olivine sand, slug sand, carbon sand, mullite sand, alumina sand, chamotte sand, ceramic sand, porous ceramic sand, fused ceramic sand, various kinds of glass sands, hollow spherical glass sand, various kinds of refractory materials in a pulverized state, metallic particles such as shot balls and reused materials thereof.

The inorganic water soluble binder is made of essential constituents of a sulfate compound (a sulfate) capable of containing water of crystallization and a borate compound which is fused by heat for baking the mold and cured by cooling. Other auxiliary binders than the above and lubricants may be added thereto. For example, the inorganic water soluble binder may be added in an amount of 2 to 6 parts by weight with respect to 100 parts by weight of the molding sand and water may be added in an amount of about ¼ to ½ of the inorganic water soluble binder.

Sulfate Compound

The sulfate compound may be a sulfate of metallic element capable of retaining water of crystallization, such as magnesium sulfate, aluminum sulfate, nickel sulfate, sodium sulfate and manganese sulfate. In this embodiment, magnesium sulfate is used alone or in combination with other sulfate compounds. The sulfate compound may be a hydrate or an anhydride. Even if an anhydride is used, the anhydride absorbs moisture when mulled with the molding sand and water, thereby turning into a hydrate.

Figure 4:
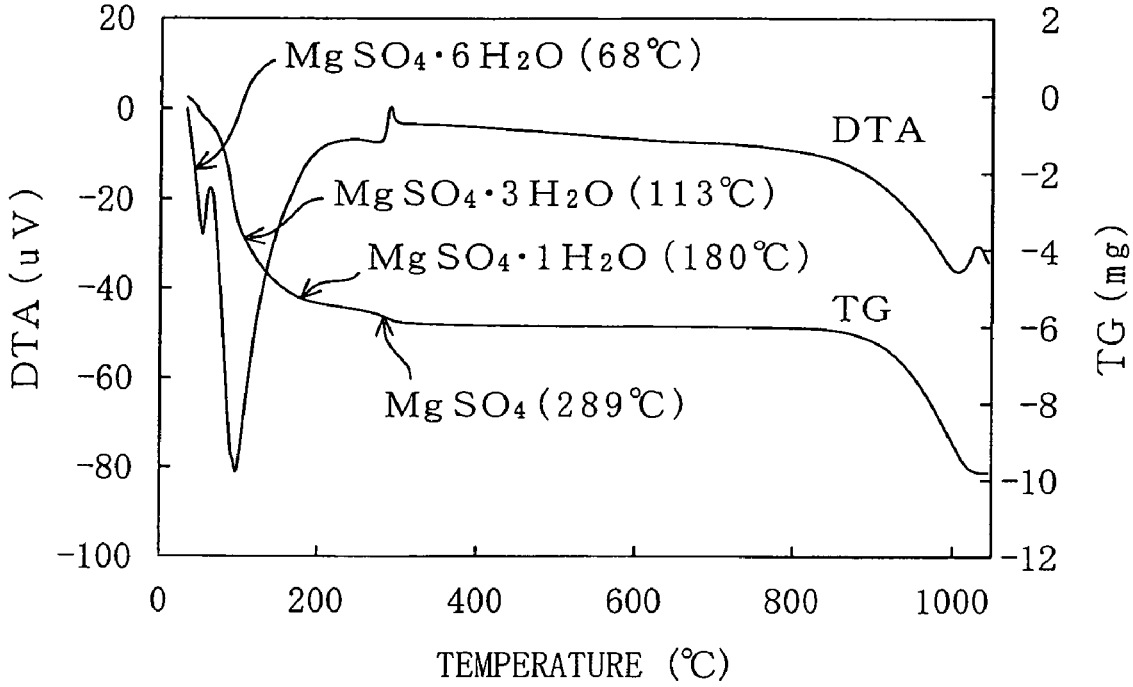
FIG. 4 is a graph illustrating the analysis results of DTA/TG on magnesium sulfate heptahydrate.

FIG. 4 shows the analysis results of DTA/TG (differential thermal analysis/thermogravimetry) on magnesium sulfate heptahydrate. According to the relationship between DTA and TG measurements, the heptahydrate turns into a hexahydrate at 68° C., a monohydrate at 180° C. and an anhydride at 289° C. Further, it is presumed that the heptahydrate turns into a trihydrate at 113° C.

Figure 5:
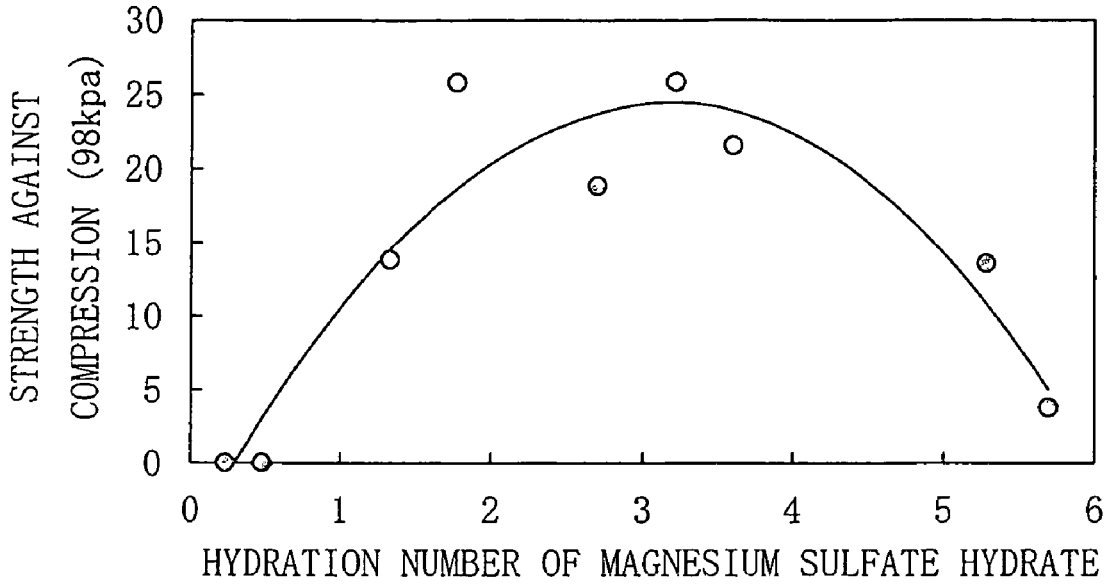
FIG. 5 is a graph illustrating a relationship between hydration number of magnesium sulfate and strength of a mold.

FIG. 5 shows a relationship between hydration number of magnesium sulfate and strength of a mold. The data was obtained by the following experiment. In 100 parts by weight of silica sand (Flattery), 3 parts by weight of magnesium sulfate heptahydrate; and 2.4 parts by weight of water were mixed to prepare mulled sand. The mulled sand was compacted three times using a test piece compactor which conforms to JIS Z 2601 to mold a columnar test piece of 30 mm diameter and 50 mm length. Then, the test piece was heated by irradiation with a microwave of 700 W. The duration of microwave irradiation was adjusted to obtain test pieces having different hydration numbers of magnesium sulfate and their strengths against compression were measured. The hydration number was determined by heating each of the test pieces until magnesium sulfate therein turns into an anhydride and obtaining a difference between the masses of the test piece before and after the heating.

As shown in FIG. 5, magnesium sulfate gives significant strength against compression to the test piece when the hydration number is 1 to 5. The strength becomes high when the hydration number is 3 to 4. Therefore, in use of magnesium sulfate, a mold of high strength is obtained if the baking temperature is controlled such that the mold temperature reaches 113° C. at which a trihydrate is obtained.

Figure 6:
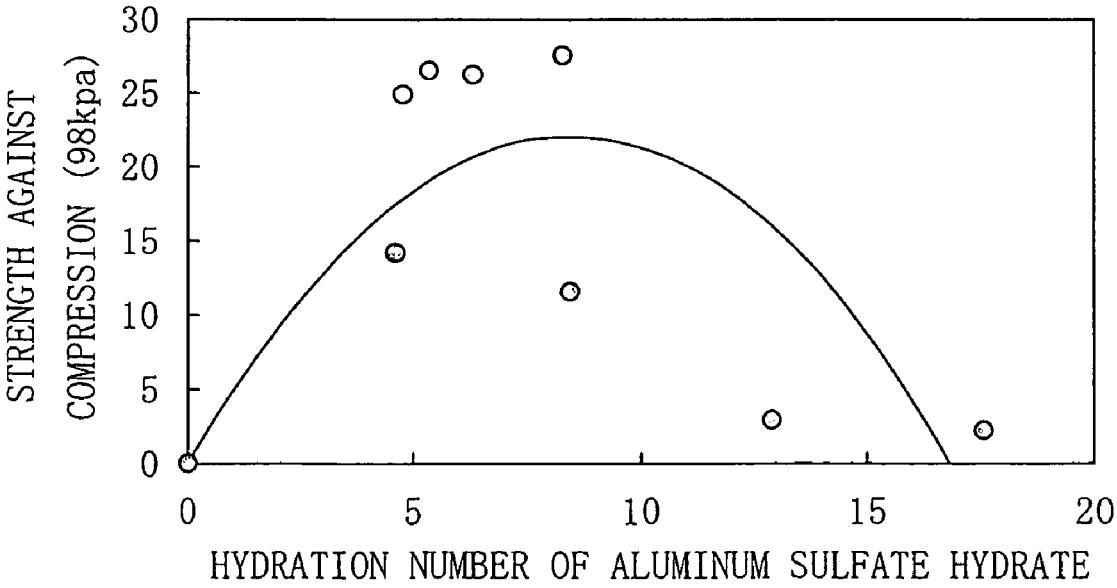
FIG. 6 is a graph illustrating a relationship between hydration number of aluminum sulfate and strength of a mold.

FIG. 6 shows a relationship between hydration number of aluminum sulfate and strength of a mold. Aluminum sulfate gives high strength against compression to the mold when the hydration number is approximately 4 to 10.

Figure 7:
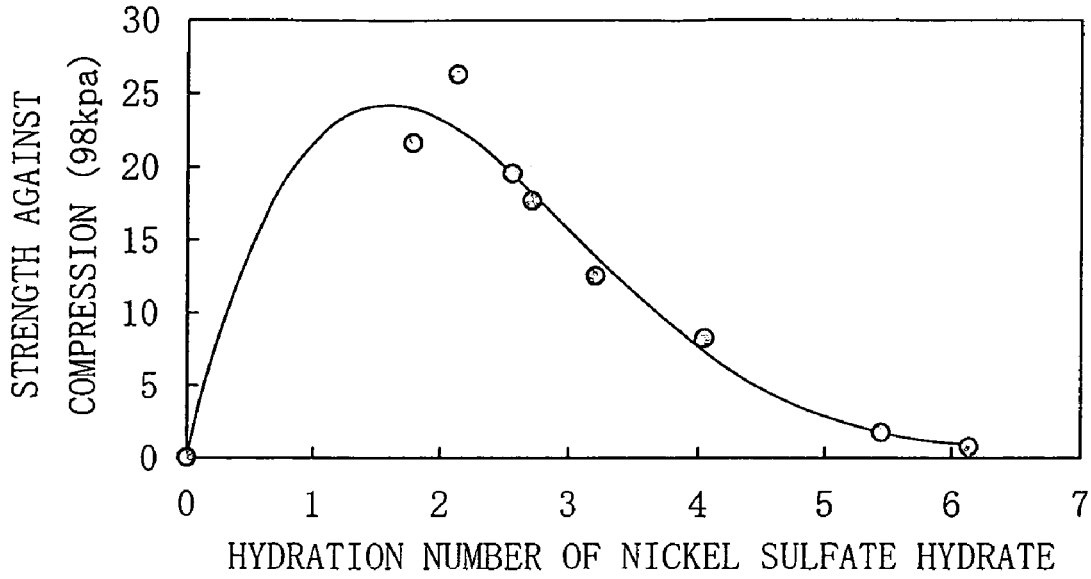
FIG. 7 is a graph illustrating a relationship between hydration number of nickel sulfate and strength of a mold.

FIG. 7 shows a relationship between hydration number of nickel sulfate and strength of a mold. Nickel sulfate gives high strength against compression to the mold when the hydration number is approximately 1.7 to 4.1.

Figure 8:
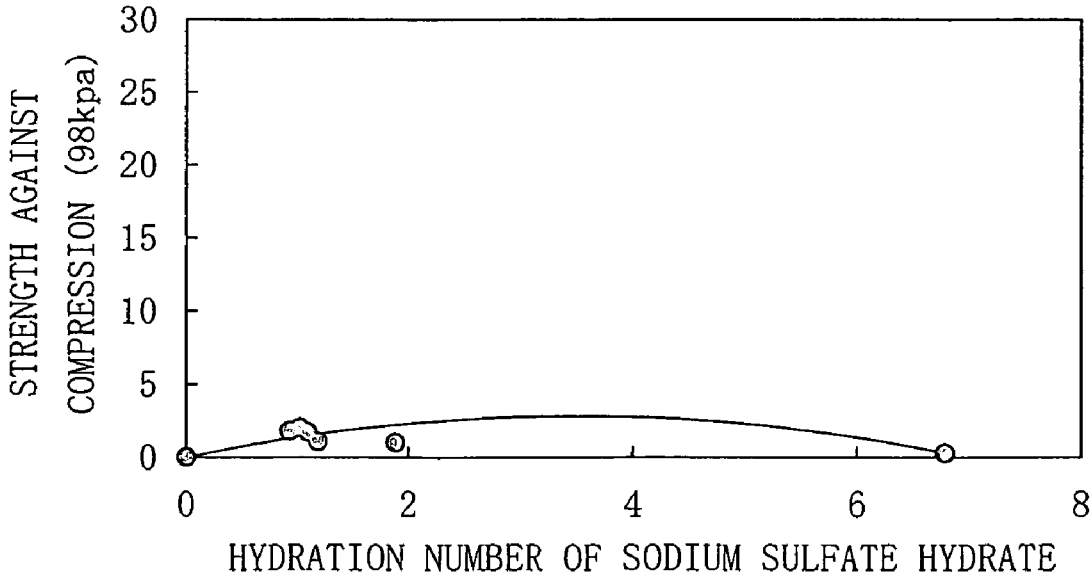
FIG. 8 is a graph illustrating a relationship between hydration number of sodium sulfate and strength of a mold.

FIG. 8 shows a relationship between hydration number of sodium sulfate and strength of a mold. Sodium sulfate gives strength against compression to the mold when the hydration number is approximately 0.8 to 1.9.

Figure 9:
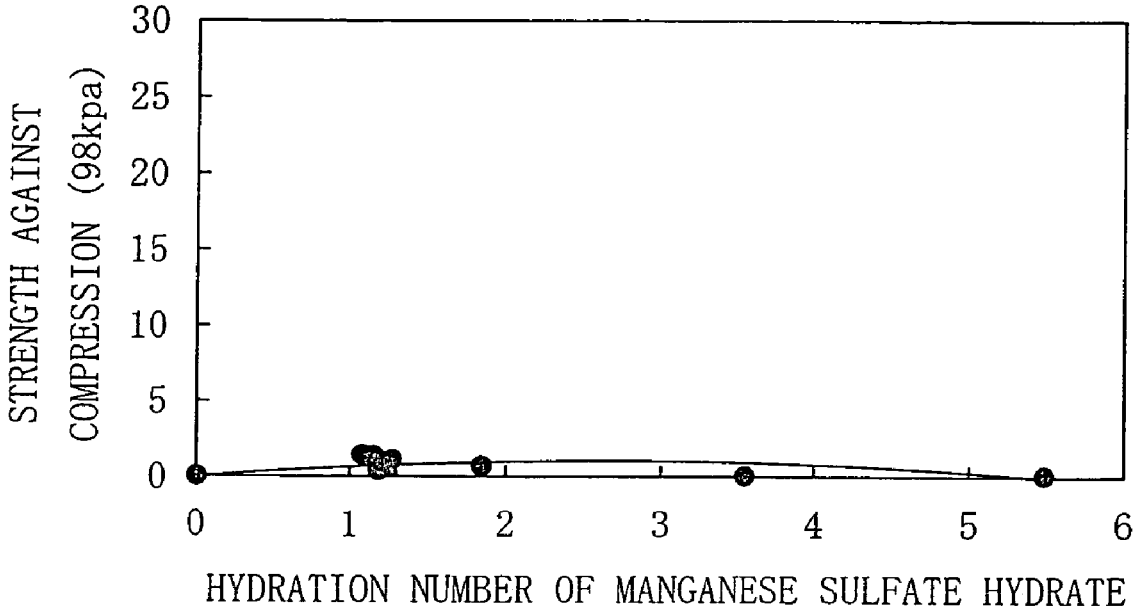
FIG. 9 is a graph illustrating a relationship between hydration number of manganese sulfate and strength of a mold.

FIG. 9 shows a relationship between hydration number of manganese sulfate and strength of a mold. Manganese sulfate gives strength against compression to the mold when the hydration number is approximately 1 to 2.

Table 1 below shows a relationship among the duration of microwave irradiation for the test pieces made of different sulfate compounds, strength of the test pieces against compression and hydration number of the sulfate compounds.

TABLE 1

| | Strength against compression (98 kPa)/value in the brackets is hydration number of sulfate compound | | | | | | | |
|---|---|---|---|---|---|---|---|---|
| Test compound | 30 s | 40 s | 50 s | 60 s | 70 s | 80 s | 90 s | 180 s |
| $MgSO_4.7H_2O$ | 3.7 (5.69) | 13.5 (5.27) | 21.5 (3.57) | 25.8 (3.20) | | | | 18.8 (2.68) |
| $Al_2(SO_4)_3.14–18H_2O$ | 2.3 (17.57) | 3.0 (12.88) | 11.6 (8.42) | 27.9 (8.18) | 26.5 (6.26) | 26.8 (5.30) | 25.2 (4.69) | 4.2 (4.57) |
| $Na_2SO_4.10H_2O$ | 0.3 (6.70) | 1.1 (1.85) | 1.1 (1.17) | 1.4 (0.98) | 1.9 (0.98) | 2.1 (0.92) | 2.0 (0.92) | 1.8 (0.86) |

TABLE 1-continued

| Test compound | Strength against compression (98 kPa)/value in the brackets is hydration number of sulfate compound | | | | | | | |
|---|---|---|---|---|---|---|---|---|
| | 30 s | 40 s | 50 s | 60 s | 70 s | 80 s | 90 s | 180 s |
| $NiSO_4.6H_2O$ | 0.7 (6.17) | 1.7 (5.47) | 8.3 (4.06) | 12.6 (3.21) | 17.9 (2.71) | 19.8 (2.56) | 26.5 (2.11) | 21.9 (1.76) |
| $MnSO_4.5H_2O$ | 0.2 (5.48) | 0.2 (3.54) | 0.7 (1.84) | 0.4 (1.15) | 0.7 (1.24) | 1.2 (1.29) | 1.6 (1.06) | 1.4 (1.15) |

As clearly shown in Table 1, each of the sulfate compounds requires different duration of microwave irradiation to give high strength against compression and the duration of microwave irradiation corresponds to the temperature for heating the test pieces. Therefore, if different kinds of sulfate compounds, for example, magnesium sulfate and aluminum sulfate, are combined, variations in mold strength are suppressed even if the temperature of the mold varies by part during the baking.

If the obtained mold is not immediately used for casting, for example, magnesium sulfate contained therein absorbs moisture to increase the hydration number from 3 to 4 which contributes to high strength to 7 which gives low strength. However, if aluminum sulfate or sodium sulfate is combined with magnesium sulfate, the aluminum or sodium sulfate absorbs moisture in place of magnesium sulfate to prevent the decrease in mold strength due to the moisture absorption by magnesium sulfate.

Borate Compound

The borate compound may be one or a combination of two or more of sodium tetraborate, sodium metaborate, dipotassium tetraborate, ammonium borate, boric acid, magnesium borate, lithium tetraborate, aluminum tetraborate and manganese borate. Except boric acid, these materials may be anhydrides or hydrates. More specifically, examples of the hydrates include sodium tetraborate decahydrate, sodium metaborate tetrahydrate, dipotassium tetraborate tetrahydrate, ammonium borate tetrahydrate, lithium tetraborate pentahydrate and manganese borate octahydrate.

Figure 10:
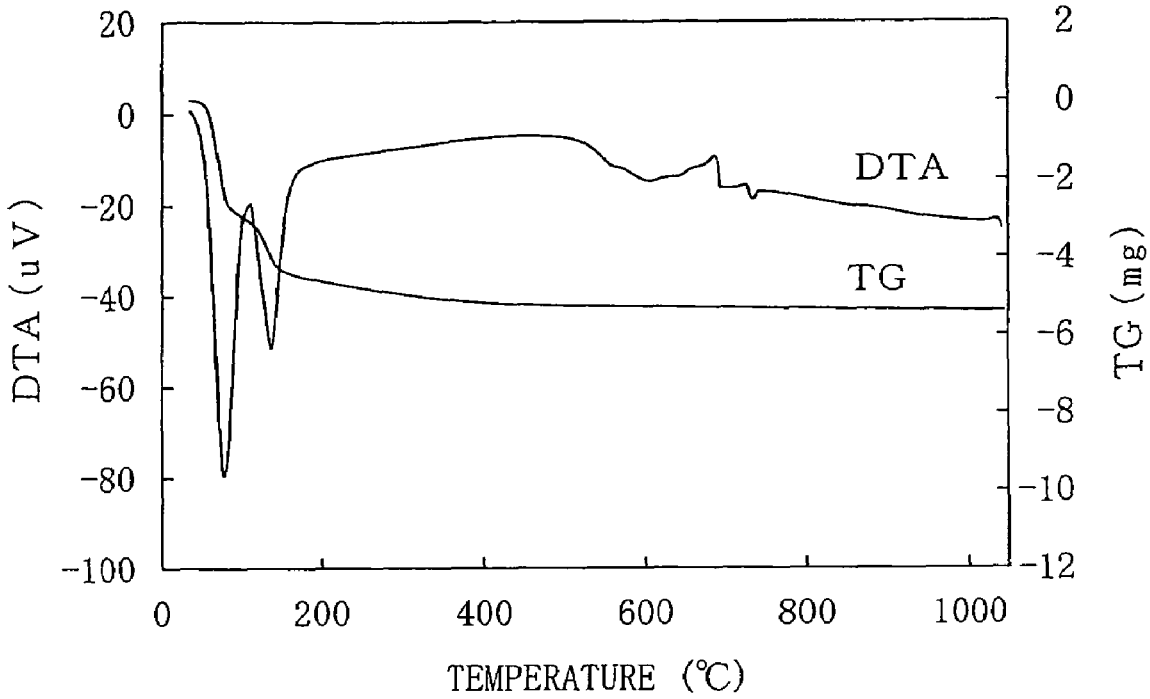
FIG. 10 is a graph illustrating the analysis results of DTA/TG on sodium tetraborate decahydrate.

FIG. 10 shows the analysis results of DTA/TG on sodium tetraborate decahydrate. Sodium tetraborate decahydrate shows an endothermic peak at 75° C. and turns into liquid at temperatures higher than 75° C. That is, the melting point of sodium tetraborate decahydrate is 75° C. Sodium metaborate tetrahydrate also has a melting point as low as about 57° C. Other borate compounds are also fused at low temperatures because they can turn into hydrates.

The borate compound is fused by heat for baking the mold, thereby acting as a heating medium which transfers heat to every part of the mold. When the mold temperature is high, the borate compound is in a fused state, thereby allowing easy release of the mold. Then, after the mold is cooled, the borate compound gives strength to the mold to cure the mold. If a warm shot molding machine is used, the borate compound is fused by contacting the heated molding die, thereby improving the filling property of the mulled sand.

Curing of a Mold Based on a Combination of Sulfate Compound and Borate Compound

Figure 11:
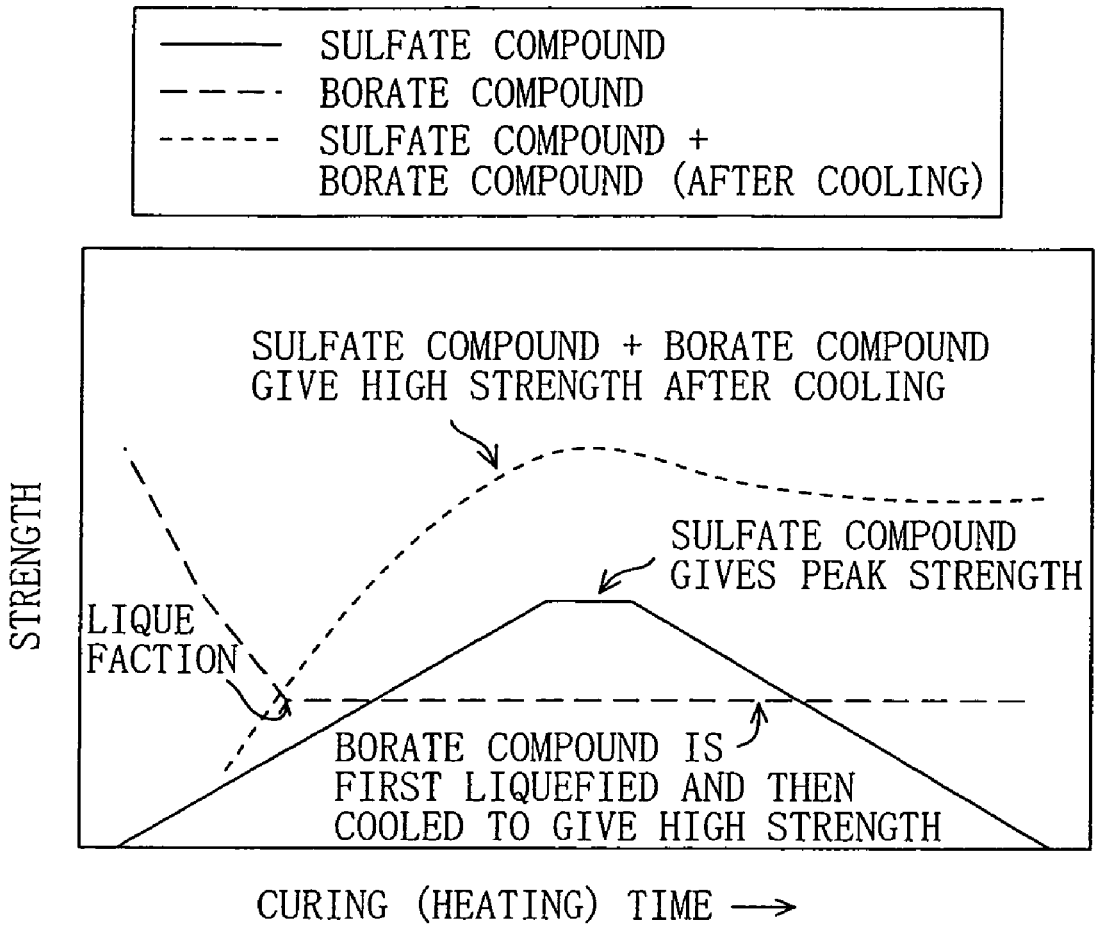
FIG. 11 is a graph schematically illustrating a relationship between heating time and strength of a mold when a binder made of a combination of a sulfate compound and a borate compound is used.

FIG. 11 is a graph schematically illustrating a relationship between mold heating time and mold strength when the above combination is used.

As the mulled sand is heated in the forming die, the sulfate compound decreases in hydration number and the mulled sand increases in strength. The strength of the mulled sand reaches a peak by heating the mulled sand for a specified period of time. If the heating is continued longer, the sulfate compound further decreases in hydration number to become an anhydride, whereby the strength of the mulled sand decreases.

On the other hand, during the heating of the mulled sand, the borate compound is fused at a relatively early stage (at low temperatures) and then cured (glassified) by the following cooling to give strength to the mold. Once fused, the borate compound gives certain strength to the mold irrespective of the duration of the heating. Therefore, with use of the combination of the sulfate compound and the borate compound, as indicated by a short dashed line in FIG. 11, the strength of the mold reaches the highest when the strength given by the sulfate compound reaches the peak. If the heating is continued longer, the mold strength decreases. However, the decrease in mold strength will not be significant owing to the action of the borate compound.

Auxiliary Binders and the Like

To the mulled sand, various kinds of auxiliary binders and other additives may be added for the purpose of improving the strength of the obtained mold, giving the strength to the mold at high temperatures, preventing the deterioration of the mold by moisture absorption, improving the curing property of the mold, reducing gas generation and improving the filling property of the mulled sand. A specific explanation is given below.

As an agent for preventing the deterioration of the mold by moisture absorption, calcium sulfate (gypsum), calcium phosphate or cement may be used.

For the purposes of improving the mold strength, preventing the deterioration of the mold by moisture absorption and improving heat resistance of the mold, sodium dihydrogen phosphate, potassium dihydrogen phosphate, tricalcium phosphate, aluminum primary phosphate or magnesium chloride may be added.

Tricalcium phosphate and magnesium chloride listed above may be hydrates.

As an agent for preventing the deterioration of the mold by moisture absorption, calcium oxide, magnesium oxide, calcium hydroxide, aluminum hydroxide or magnesium hydroxide may be added.

Talc and graphite may be added as a lubricant for improving the filling property of the mulled sand.

Further, the mulled sand may be added with a given amount of iron red, iron powder, coal powder, wood flour, starch, grain powder, silica flour, zircon flour or olivine flour to prevent defects in the resulting castings.

For improvement in filling property, the mulled sand may be added with a given amount of an inorganic lubricant such as tungsten disulfide, molybdenum disulfide, graphite and talc, an organic lubricant such as hydrocarbon-based lubricants, polyalkylene glycol, silicone-based lubricants, fluorine-based lubricants, phenyl ether and phosphoric ester or a surfactant.

Further, various coatings may be applied to the obtained mold, for example, alcoholic coatings, aqueous coatings, powdered coatings, surface stabilizers and tellurium powder for preventing surface sink.

(Combination of Magnesium Sulfate and Various Borate Compounds)

Magnesium Sulfate and Sodium Tetraborate Decahydrate

Magnesium sulfate and sodium tetraborate decahydrate were mixed in various compositions shown in Table 2. The mixture of these binder constituents and water were mixed in the mass ratio of 3:1 to prepare a binder solution. The solution was heated up to a maximum temperature of 100° C. with stirring to dissolve the binder constituents. 4 parts by weight of the resulting binder solution was added to 100 parts by weight of molding sand to obtain mulled sand.

The molding sand used was high purity silica sand of U.S.A. origin having a peak at 70-mesh (212 $\mu$m) in particle size distribution. With a warm shot molding machine, test pieces of 28 mm diameter and 50 mm length were formed by blow molding at a blowing pressure of 4×9.8 kPa for a blowing time of 2 seconds. The temperature of the mulled sand was 60° C. and the temperature of the forming die was 140° C. After the blowing, air was purged and then the test pieces were released from the die. Time indicated in the table is the duration of the air purging. After cooled to a room temperature, strengths of the test pieces were measured. Further, as a decomposition test, the test pieces were subjected to baking at 600° C. for 15 minutes, followed by cooling, and then placed in water of 500 ml in a beaker to measure time required until the test piece was decomposed.

TABLE 2

| Binder composition (parts by weight) | | State of binder | Strength against compression (98 kPa) | | | Decomposition test after baking of 600° C. × |
|---|---|---|---|---|---|---|
| $MgSO_4.7H_2O$ | $Na_2B_4O_7.10H_2O$ | solution | 15 sec | 30 sec | 60 sec | 15 min. (sec) |
| 0 | 100 | Undissolved part left | 0.0 | 0.0 | 0.0 | Mold was not obtained*1 |
| 30 | 70 | Undissolved part left | 0.0 | 0.0 | 0.0 | Mold was not obtained*1 |
| 40 | 60 | Undissolved part left | 8.1 | 3.5 | 0.0 | Not decomposed by self weight*2 |
| 50 | 50 | Dissolved | 18.1 | 13.4 | 6.5 | 7.5 |
| 75 | 25 | Dissolved | 37.9 | 46.4 | 39.7 | 4.0 |
| 99 | 1 | Dissolved | 0.0 | 6.6 | 9.1 | 4.0 |
| 99.5 | 0.5 | Dissolved | 0.0 | 4.4 | 7.4 | 4.0 |
| 100 | 0 | Dissolved | 0.0 | 3.8 | 6.7 | 4.0 |

*1Not measured
*2Decomposed when stirred

Referring to Table 2, when 100 parts by weight of magnesium sulfate heptahydrate is contained, the mold strength is not given to the test mold after 15-second air purging. The strengths obtained after 30- and 60-second air purging is 3.8 (×9.8) kPa and 6.7 (×9.8) kPa, respectively, which are not so high. With the addition of 25 parts by weight of sodium tetraborate decahydrate, the test piece is molded by the 15-second air purging and the obtained strength is as high as 37.9 (×9.8) kPa. However, when 100 parts by weight of sodium tetraborate decahydrate is added, the strength is not obtained while the temperature of the test mold is high after the baking. Therefore, the test piece cannot be released from the forming die.

As to the state of the binder solution, the binder constituents are dissolved completely in water when the content of sodium tetraborate decahydrate is 50 parts by weight. However, part of the binder constituents is left undissolved when the content of sodium tetraborate decahydrate is 60 parts by weight, though at this time the strength is given after the 15-second air purging. As a result of the decomposition test, the test pieces are decomposed when the content of sodium tetraborate hydrate is 0 to 60 parts by weight.

From the above results, it is concluded that a water soluble, fast curing mold can be obtained when up to 60 parts by weight of sodium tetraborate decahydrate is contained in the binder (60 mass % with respect to the total amount of the binder).

Magnesium Sulfate Heptahydrate and Sodium Metaborate Tetrahydrate

Table 3 shows the characteristics of water soluble molds obtained using binders based on different compositions of magnesium sulfate heptahydrate and sodium metaborate tetrahydrate. Conditions of the evaluations are the same as those adopted for the combination of magnesium sulfate and sodium tetraborate decahydrate (Table 2).

TABLE 3

| Binder composition (parts by weight) | | State of binder | Strength against compression (98 kPa) | | | Decomposition test after baking of 600° C. × |
|---|---|---|---|---|---|---|
| $MgSO_4.7H_2O$ | $NaBO_2.4H_2O$ | solution | 15 sec | 30 sec | 60 sec | 15 min. (sec) |
| 0 | 100 | Undissolved part left | 0.0 | 0.0 | 0.0 | Mold was not obtained*1 |
| 50 | 50 | Undissolved part left | 3.1 | 5.9 | 0.0 | Not decomposed by self weight*2 |

TABLE 3-continued

| Binder composition (parts by weight) | | State of binder | Strength against compression (98 kPa) | | | Decomposition test after baking of 600° C. × |
|---|---|---|---|---|---|---|
| $MgSO_4.7H_2O$ | $NaBO_2.4H_2O$ | solution | 15 sec | 30 sec | 60 sec | 15 min. (sec) |
| 70 | 30 | Undissolved part left | 18.9 | 26.7 | 21.4 | Not decomposed by self weight*2 |
| 80 | 20 | Undissolved part left | 37.9 | 38.4 | 33.2 | Not decomposed by self weight*2 |
| 90 | 10 | Dissolved | 29.6 | 32.1 | 31.7 | 4.0 |
| 95 | 5 | Dissolved | 30.7 | 24.0 | 19.7 | 4.0 |
| 99 | 1 | Dissolved | 15.0 | 8.3 | 15.6 | 4.0 |
| 99.5 | 0.5 | Dissolved | 6.9 | 5.9 | 8.2 | 4.0 |
| 100 | 0 | Dissolved | 0.0 | 3.8 | 6.7 | 4.0 |

*1Not measured
*2Decomposed when stirred

The highest mold strength is obtained when 20 parts by weight of sodium metaborate tetrahydrate is added, but at the same time, part of sodium metaborate tetrahydrate is left undissolved. Table 3 indicates that a water soluble, fast curing mold ba be obtained when up to 50 parts by weight of sodium metaborate tetrahydrate is contained in the binder (50 mass % with respect to the total amount of the binder).

Magnesium Sulfate Heptahydrate and Dipotassium Tetraborate Tetrahydrate

Table 4 shows the characteristics of water soluble molds obtained using binders based on different compositions of magnesium sulfate heptahydrate and dipotassium tetraborate tetrahydrate. Conditions of the evaluations are the same as those adopted for the combination of magnesium sulfate and sodium tetraborate decahydrate (Table 2).

TABLE 4

| Binder composition (parts by weight) | | State of binder | Strength against compression (98 kPa) | | | Decomposition test after baking of 600° C. × |
|---|---|---|---|---|---|---|
| $MgSO_4.7H_2O$ | $K_2B_4O_7.4H_2O$ | solution | 15 sec | 30 sec | 60 sec | 15 min. (sec) |
| 0 | 100 | Undissolved part left | 0.0 | 0.0 | 0.0 | Not decomposed by self weight*2 |
| 25 | 75 | Undissolved part left | 4.3 | 0.0 | 0.0 | Not decomposed by self weight*2 |
| 50 | 50 | Dissolved | 4.1 | 6.2 | 0.0 | Not decomposed by self weight*2 |
| 75 | 25 | Dissolved | 19.7 | 13.7 | 6.3 | 5.5 |
| 90 | 10 | Dissolved | 26.6 | 22.9 | 14.1 | 4.0 |
| 95 | 5 | Dissolved | 28.8 | 24.6 | 18.3 | 4.0 |
| 100 | 0 | Dissolved | 0.0 | 3.8 | 6.7 | 4.0 |

*1Not measured
*2Decomposed when stirred

The highest mold strength is obtained when the content of dipotassium tetraborate tetrahydrate is 10 parts by weight. Dipotassium tetraborate tetrahydrate is partially left undissolved when the content thereof is 75 parts by weight or more. Table 4 indicates that a water soluble, fast curing mold can be obtained when up to 75 parts by weight of dipotassium tetraborate tetrahydrate is contained in the binder (75 mass % with respect to the total amount of the binder).

Magnesium Sulfate Heptahydrate and Sodium Tetraborate (Anhydrous)

Table 5 shows the characteristics of water soluble molds obtained using binders based on different compositions of magnesium sulfate heptahydrate and sodium tetraborate (anhydrous). Conditions of the evaluations are the same as those adopted for the combination of magnesium sulfate and sodium tetraborate decahydrate (Table 2).

TABLE 5

| Binder composition (parts by weight) | | State of binder | Strength against compression (98 kPa) | | | Decomposition test after baking of 600° C. × |
|---|---|---|---|---|---|---|
| $MgSO_4.7H_2O$ | $Na_2B_4O_7$ | solution | 15 sec | 30 sec | 60 sec | 15 min. (sec) |
| 0 | 100 | Undissolved part left | 0.0 | 0.0 | 0.0 | Mold was not obtained*1 |

TABLE 5-continued

| Binder composition (parts by weight) | | State of binder | Strength against compression (98 kPa) | | | Decomposition test after baking of 600° C. × |
|---|---|---|---|---|---|---|
| $MgSO_4.7H_2O$ | $Na_2B_4O_7$ | solution | 15 sec | 30 sec | 60 sec | 15 min. (sec) |
| 40 | 60 | Undissolved part left | 5.5 | 0.0 | 0.0 | Not decomposed by self weight*2 |
| 50 | 50 | Undissolved part left | 7.4 | 11.3 | 4.5 | Not decomposed by self weight*2 |
| 75 | 25 | Undissolved part left | 25.4 | 22.6 | 15.9 | Not decomposed by self weight*2 |
| 90 | 10 | Undissolved part left | 35.3 | 28.6 | 27.7 | 11.5 |
| 95 | 5 | Dissolved | 32.1 | 27.2 | 22.5 | 9.0 |
| 100 | 0 | Dissolved | 0.0 | 3.8 | 6.7 | 4.0 |

*1Not measured
*2Decomposed when stirred

The highest mold strength is obtained when the content of sodium tetraborate (anhydrous) is 10 parts by weight, but at the same time, part of sodium tetraborate (anhydrous) is left undissolved. Table 5 indicates that a water soluble, fast curing mold can be obtained when up to 60 parts by weight of sodium tetraborate (anhydrous) is contained in the binder (60 mass % with respect to the total amount of the binder).

Magnesium Sulfate Heptahydrate and Ammonium Borate

Table 6 shows the characteristics of water soluble molds obtained using binders based on different compositions of magnesium sulfate heptahydrate and ammonium borate. Conditions of the evaluations are the same as those adopted for the combination of magnesium sulfate and sodium tetraborate decahydrate (Table 2).

TABLE 6

| Binder composition (parts by weight) | | State of binder | Strength against compression (98 kPa) | | | Decomposition test after baking of 600° C. × |
|---|---|---|---|---|---|---|
| $MgSO_4.7H_2O$ | $NH_4B_5O_8.4H_2O$ | solution | 15 sec | 30 sec | 60 sec | 15 min. (sec) |
| 0 | 100 | Undissolved part left | 0.0 | 0.0 | 0.0 | Mold was not obtained*1 |
| 40 | 60 | Undissolved part left | 5.5 | 1.2 | 0.0 | Not decomposed by self weight*2 |
| 50 | 50 | Undissolved part left | 7.2 | 10.3 | 5.0 | Not decomposed by self weight*2 |
| 75 | 25 | Undissolved part left | 32.1 | 26.0 | 21.9 | Not decomposed by self weight*2 |
| 90 | 10 | Dissolved | 28.7 | 25.1 | 17.4 | 18.0 |
| 95 | 5 | Dissolved | 17.8 | 16.3 | 13.9 | 16.5 |
| 100 | 0 | Dissolved | 0.0 | 3.8 | 6.7 | 4.0 |

*1Not measured
*2Decomposed when stirred

The highest mold strength is obtained when the content of ammonium borate is 10 parts by weight. Ammonium borate is partially left undissolved when the content thereof is 25 parts by weight or more. Table 6 indicates that a water soluble, fast curing mold can be obtained when up to 60 parts by weight of ammonium borate is contained in the binder (60 mass % with respect to the total amount of the binder).

Magnesium Sulfate Heptahydrate and Boric Acid

Table 7 shows the characteristics of water soluble molds obtained using binders based on different compositions of magnesium sulfate heptahydrate and boric acid. Conditions of the evaluations are the same as those adopted for the combination of magnesium sulfate and sodium tetraborate decahydrate (Table 2).

TABLE 7

| Binder composition (parts by weight) | | State of binder | Strength against compression (98 kPa) | | | Decomposition test after baking of 600° C. × |
|---|---|---|---|---|---|---|
| $MgSO_4.7H_2O$ | $H_3BO_3$ | solution | 15 sec | 30 sec | 60 sec | 15 min. (sec) |
| 0 | 100 | Undissolved part left | 0.0 | 0.0 | 0.0 | Mold was not obtained*1 |

TABLE 7-continued

| Binder composition (parts by weight) | | State of binder | Strength against compression (98 kPa) | | | Decomposition test after baking of 600° C. × |
|---|---|---|---|---|---|---|
| $MgSO_4.7H_2O$ | $H_3BO_3$ | solution | 15 sec | 30 sec | 60 sec | 15 min. (sec) |
| 40 | 60 | Undissolved part left | 6.7 | 8.4 | 4.1 | Not decomposed by self weight*2 |
| 50 | 50 | Undissolved part left | 5.0 | 6.5 | 9.9 | 38.0 |
| 75 | 25 | Undissolved part left | 10.8 | 23.4 | 9.3 | 26.0 |
| 90 | 10 | Undissolved part left | 8.8 | 24.0 | 13.6 | 22.0 |
| 95 | 5 | Dissolved | 18.9 | 30.8 | 26.6 | 7.3 |
| 100 | 0 | Dissolved | 0.0 | 3.8 | 6.7 | 4.0 |

*1Not measured
*2Decomposed when stirred

The highest mold strength is obtained when the content of boric acid is 5 parts by weight. Boric acid is partially left undissolved when the content thereof is 10 parts by weight or more. Table 7 indicates that a water soluble, fast curing mold can be obtained when up to 60 parts by weight of boric acid is contained in the binder (60 mass % with respect to the total amount of the binder).

Magnesium Sulfate Heptahydrate and Magnesium Borate

Table 8 shows the characteristics of water soluble molds obtained using binders based on different compositions of magnesium sulfate heptahydrate and magnesium borate. Conditions of the evaluations are the same as those adopted for the combination of magnesium sulfate and sodium tetraborate decahydrate (Table 2).

The highest mold strength is obtained when the content of magnesium borate is 25 parts by weight. Magnesium borate is partially left undissolved when the content thereof is 5 parts by weight or more. Table 8 indicates that a water soluble, fast curing mold can be obtained when up to 60 parts by weight of magnesium borate is contained in the binder (60 mass % with respect to the total amount of the binder).

Magnesium Sulfate Heptahydrate and Lithium Tetraborate Pentahydrate

Table 9 shows the characteristics of water soluble molds obtained using binders based on different compositions of magnesium sulfate heptahydrate and lithium tetraborate pentahydrate. Conditions of the evaluations are the same as those adopted for the combination of magnesium sulfate and sodium tetraborate decahydrate (Table 2).

TABLE 8

| Binder composition (parts by weight) | | State of binder | Strength against compression (98 kPa) | | | Decomposition test after baking of 600° C. × |
|---|---|---|---|---|---|---|
| $MgSO_4.7H_2O$ | $MgB_2O_4$ | solution | 15 sec | 30 sec | 60 sec | 15 min. (sec) |
| 0 | 100 | Undissolved part left | 0.0 | 0.0 | 0.0 | Mold was not obtained*1 |
| 40 | 60 | Undissolved part left | 5.8 | 7.3 | 0.0 | Not decomposed by self weight*2 |
| 50 | 50 | Undissolved part left | 10.6 | 4.3 | 3.5 | Not decomposed by self weight*2 |
| 75 | 25 | Undissolved part left | 18.4 | 18.6 | 9.5 | Not decomposed by self weight*2 |
| 90 | 10 | Undissolved part left | 8.3 | 21.4 | 18.3 | 23.0 |
| 95 | 5 | Undissolved part left | 6.8 | 14.1 | 9.9 | 6.9 |
| 100 | 0 | Dissolved | 0.0 | 3.8 | 6.7 | 4.0 |

*1Not measured
*2Decomposed when stirred

TABLE 9

| Binder composition (parts by weight) | | State of binder | Strength against compression (98 kPa) | | | Decomposition test after baking of 600° C. × |
|---|---|---|---|---|---|---|
| $MgSO_4.7H_2O$ | $Li_2B_4O_7.5H_2O$ | solution | 15 sec | 30 sec | 60 sec | 15 min. (sec) |
| 0 | 100 | Undissolved part left | 0.0 | 0.0 | 0.0 | Mold was not obtained*1 |
| 40 | 60 | Undissolved part left | 12.1 | 6.5 | 1.2 | Not decomposed by self weight*2 |
| 50 | 50 | Undissolved part left | 13.4 | 22.0 | 11.7 | 25.0 |
| 75 | 25 | Undissolved part left | 29.2 | 34.5 | 33.4 | 22.0 |
| 90 | 10 | Undissolved part left | 17.9 | 32.6 | 31.2 | 15.0 |
| 95 | 5 | Undissolved part left | 8.2 | 21.1 | 12.8 | 5.0 |
| 100 | 0 | Dissolved | 0.0 | 3.8 | 6.7 | 4.0 |

*1Not measured
*2Decomposed when stirred

The highest mold strength is obtained when the content of lithium tetraborate pentahydrate is 25 parts by weight. Lithium tetraborate pentahydrate is partially left undissolved when the content thereof is 5 parts by weight or more. Table 9 indicates that a water soluble, fast curing mold can be obtained when up to 60 parts by weight of lithium tetraborate pentahydrate is contained in the binder (60 mass % with respect to the total amount of the binder).

Magnesium Sulfate Heptahydrate and Aluminum Borate

Table 10 shows the characteristics of water soluble molds obtained using binders based on different compositions of magnesium sulfate heptahydrate and aluminum borate. Conditions of the evaluations are the same as those adopted for the combination of magnesium sulfate and sodium tetraborate decahydrate (Table 2).

The highest mold strength is obtained when the content of aluminum borate is 25 parts by weight. Aluminum borate is partially left undissolved when the content thereof is 5 parts by weight or more. Table 10 indicates that a water soluble, fast curing mold can be obtained when up to 60 parts by weigh of aluminum borate is contained in the binder (60 mass % with respect to the total amount of the binder).

Magnesium Sulfate Heptahydrate and Manganese Borate Octahydrate

Table 11 shows the characteristics of water soluble molds obtained using binders based on different compositions of magnesium sulfate heptahydrate and manganese borate octahydrate. Conditions of the evaluations are the same as those adopted for the combination of magnesium sulfate and sodium tetraborate decahydrate (Table 2).

TABLE 10

| Binder composition (parts by weight) | | State of binder | Strength against compression (98 kPa) | | | Decomposition test after baking of 600° C. × |
|---|---|---|---|---|---|---|
| $MgSO_4.7H_2O$ | Aluminum borate | solution | 15 sec | 30 sec | 60 sec | 15 min. (sec) |
| 0 | 100 | Undissolved part left | 0.0 | 0.0 | 0.0 | Mold was not obtained*1 |
| 40 | 60 | Undissolved part left | 7.1 | 2.7 | 0.0 | Not decomposed by self weight*2 |
| 50 | 50 | Undissolved part left | 15.4 | 19.9 | 10.4 | Not decomposed by self weight*2 |
| 75 | 25 | Undissolved part left | 28.8 | 25.0 | 23.7 | 31.5 |
| 95 | 5 | Undissolved part left | 15.5 | 24.7 | 21.3 | 8.5 |
| 100 | 0 | Dissolved | 0.0 | 3.8 | 6.7 | 4.0 |

*1Not measured
*2Decomposed when stirred

TABLE 11

| Binder composition (parts by weight) | | State of binder | Strength against compression (98 kPa) | | | Decomposition test after baking of 600° C. × 15 min. |
|---|---|---|---|---|---|---|
| $MgSO_4.7H_2O$ | $MnB_2O_7.8H_2O$ | solution | 15 sec | 30 sec | 60 sec | (sec) |
| 0 | 100 | Undissolved part left | 0.0 | 0.0 | 0.0 | Mold was not obtained*1 |
| 40 | 60 | Undissolved part left | 3.2 | 6.5 | 5.6 | Not decomposed by self weight*2 |
| 50 | 50 | Undissolved part left | 9.2 | 10.3 | 12.0 | 15.0 |
| 75 | 25 | Undissolved part left | 17.7 | 18.1 | 23.6 | 7.0 |
| 95 | 5 | Dissolved | 18.4 | 26.6 | 25.9 | 4.5 |
| 100 | 0 | Dissolved | 0.0 | 3.8 | 6.7 | 4.0 |

*1Not measured
*2Decomposed when stirred

The highest mold strength is obtained when the content of manganese borate octahydrate is 25 parts by weight. Manganese borate octahydrate is partially left undissolved when the content thereof is 5 parts by weight or more. Table 11 indicates that a water soluble, fast curing mold can be obtained when up to 60 parts by weight of manganese borate octahydrate is contained in the binder (60 mass % with respect to the total amount of the binder).

A Combination of Two or More Sulfate Compounds and a Combination of One or More Borate Compounds Table 12 shows the characteristics of water soluble molds obtained by using binders made of a combination of two or more sulfate compounds and one or more borate compounds. Conditions of the evaluations are the same as those adopted for the combination of magnesium sulfate and sodium tetraborate decahydrate (Table 2).

The sulfate compounds used were magnesium sulfate heptahydrate, sodium sulfate decahydrate and aluminum sulfate tetradeca- to octadecahydrate. As the borate compounds, sodium tetraborate decahydrate (Table 2), sodium metaborate tetrahydrate (Table 3) and lithium tetraborate pentahydrate (Table 9) were selected among those shown in Tables 2 to 11 because they showed favorable strength and decomposition property. These borate compounds were used in their optimum compositions shown in Tables 2, 3 and 9. An example containing the three borate compounds each in an amount of 5 parts by weight was also examined.

Magnesium sulfate heptahydrate and sodium sulfate decahydrate were mixed in the ratio of 75:25. Magnesium sulfate heptahydrate, sodium sulfate decahydrate and aluminum sulfate tetradeca- to octadecahydrate were mixed in the ratio of 50:25:25.

TABLE 12

| Binder composition (parts by weight) | | | | | | State of binder | Strength against compression (98 kPa) | | | Decomposition test after baking of 600° C. × 15 min. (sec) |
|---|---|---|---|---|---|---|---|---|---|---|
| $MgSO_4.7H_2O$ | $Na_2SO_4.10H_2O$ | $Al_2(SO_4)_3.14–18H_2O$ | $Na_2B_4O_7.10H_2O$ | $NaBO_2.4H_2O$ | $Li_2B_4O_7.5H_2O$ | solution | 15 sec | 30 sec | 60 sec | |
| 56.25 | 18.75 | | 25 | | | Dissolved | 35.4 | 44.5 | 45.0 | 4.0 |
| 37.5 | 18.25 | 18.25 | 25 | | | Dissolved | 29.9 | 43.3 | 42.2 | 4.0 |
| 71.25 | 23.75 | | | 5 | | Dissolved | 30.0 | 37.1 | 29.9 | 4.0 |
| 47.5 | 23.75 | 23.75 | | 5 | | Dissolved | 24.7 | 35.6 | 38.6 | 4.0 |
| 56.25 | 18.75 | | | | 25 | Undissolved part left | 28.2 | 36.3 | 36.3 | 24.0 |
| 37.5 | 18.25 | 18.25 | | | 25 | Undissolved part left | 24.9 | 34.2 | 41.4 | 29.0 |
| 63.75 | 21.25 | | 5 | 5 | 5 | Dissolved | 32.4 | 41.5 | 42.3 | 4.0 |
| 42.5 | 21.25 | 21.25 | 5 | 5 | 5 | Dissolved | 28.7 | 40.4 | 43.6 | 4.0 |

Table 12 indicates that a water soluble, fast curing mold can be obtained even if different sulfate compounds are combined. As compared with the sole use of magnesium sulfate heptahydrate, the mold strengths after the 15- and 60-second air purging are uniformed. This signifies that each of the different sulfate compounds reaches the hydration number which allows curing of the mold at different time points, i.e., they give peak strength to the mold at different temperatures. In other words, a combination of different sulfate compounds widens the range of time in which the mold is preferably cured. Further, the addition of three different borate compounds also allows obtaining water soluble, fast curing molds.

Influence of Addition of Chloride

Table 13 shows the influence of addition of magnesium chloride hexahydrate on the characteristics of water soluble molds based on various combinations of magnesium sulfate heptahydrate and sodium tetraborate decahydrate. Conditions of the evaluations are the same as those adopted for the combination of magnesium sulfate and sodium tetraborate decahydrate (Table 2) except that the strength against compression after 10-second air purging was also checked.

TABLE 13

| Binder composition (parts by weight) | | | State of binder | Strength against compression (98 kPa) | | | | Decomposition test after baking of 600° C. × |
|---|---|---|---|---|---|---|---|---|
| $MgSO_4.7H_2O$ | $MgCl_2.6H_2O$ | $Na_2B_4O_7.10H_2O$ | solution | 10 sec | 15 sec | 30 sec | 60 sec | 15 min. (sec) |
| 75 | | 25 | Dissolved | 7.0 | 37.9 | 46.4 | 39.7 | 4.0 |
| 62.5 | 12.5 | 25 | Undissolved part left | 16.2 | 25.7 | 31.6 | 27.7 | 4.0 |
| 50 | 25 | 25 | Undissolved part left | 13.4 | 21.6 | 26.3 | 25.5 | 5.0 |
| 37.5 | 37.5 | 25 | Undissolved part left | 6.5 | 10.7 | 29.9 | 30.4 | 7.0 |

Table 13 shows that the addition of 12.5 to 25 parts by weight of magnesium chloride hexahydrate gives high mold strength after the 10-second curing, i.e., it effectively achieves fast curing. The fast curing property is considered to be derived from the hydration number of magnesium chloride hexahydrate which is lower than the hydration number of magnesium sulfate heptahydrate.

Influence of the Addition of Phosphate Compound

Table 14 shows the influence of the addition of phosphate compounds on the characteristics of water soluble molds based on various combinations of magnesium sulfate heptahydrate and sodium tetraborate decahydrate or sodium metaborate tetrahydrate. Conditions of the evaluations are the same as those adopted for the combination of magnesium sulfate and sodium tetraborate decahydrate (Table 2). The phosphate compounds used were sodium dihydrogen phosphate, potassium dihydrogen phosphate and tricalcium phosphate.

Among the phosphate compounds, sodium dihydrogen phosphate and potassium dihydrogen phosphate are fused by heating and then cured by cooling as the borate compounds are. The difference from the borate compounds is that the phosphate compounds are fused at slightly higher temperatures. The addition of the phosphate compound to the combination of magnesium sulfate heptahydrate and sodium metaborate tetrahydrate increases the mold strength obtained after the 60-second air purging as compared with the same combination to which the phosphate compound is not added (see Table 3).

Table 15 shows the mold strengths obtained when sodium dihydrogen phosphate or potassium dihydrogen phosphate is added to the combination of magnesium sulfate heptahydrate and sodium metaborate tetrahydrate and the temperature of the forming die is set to 175° C. Other conditions of

TABLE 14

| Binder composition (parts by weight) | | | | | | State of binder | Strength against compression (98 kPa) | | | Decomposition test after baking of 600° C. × |
|---|---|---|---|---|---|---|---|---|---|---|
| $MgSO_4.7H_2O$ | $Na_2B_4O_7.10H_2O$ | $NaBO_2.4H_2O$ | $NaH_2PO_4$ | $KH_2PO_4$ | $Ca_3(PO_4)_2$ | solution | 15 sec | 30 sec | 60 sec | 15 min. (sec) |
| 71.25 | 23.75 | | 5 | | | Gelled | 11.6 | 18.8 | 15.2 | 5.5 |
| 90.25 | | 4.75 | 5 | | | Dissolved | 23.6 | 28.3 | 27.6 | 5.0 |
| 56.25 | 18.75 | | 25 | | | Undissolved part left | 24.6 | 22.8 | 26.0 | Not decomposed by self weight*2 |
| 71.25 | | 3.75 | 25 | | | Undissolved part left | 31.1 | 43.9 | 43.0 | 18 |
| 71.25 | 23.75 | | | 5 | | Gelled | 44.1 | 38.9 | 40.4 | 8 |
| 90.25 | | 4.75 | | 5 | | Dissolved | 25.1 | 22.4 | 24.9 | 11.5 |
| 56.25 | 18.75 | | | 25 | | Undissolved part left | 15.4 | 21.2 | 21.9 | Not decomposed by self weight*2 |
| 71.25 | | 3.75 | | 25 | | Undissolved part left | 19.4 | 24.3 | 26.7 | Not decomposed by self weight*2 |
| 71.25 | 23.75 | | | | 5 | Undissolved part left | 27.0 | 35.5 | 40.2 | 5 |
| 90.25 | | 4.75 | | | 5 | Undissolved part left | 32.9 | 38.3 | 39.1 | 4 |
| 56.25 | 18.75 | | | | 25 | Undissolved part left | 18.3 | 25.1 | 30.6 | 9 |
| 71.25 | | 3.75 | | | 25 | Undissolved part left | 19.2 | 24.5 | 33.3 | 9.5 |

*2Decomposed when stirred

It is understood that the addition of the phosphate compound also allows fast curing by the 15-second air purging. the evaluations than the above are the same as those adopted in the evaluations shown in Table 2.

TABLE 15

| Binder composition (parts by weight) | | | | State of binder solution | Strength against compression (98 kPa) 175° C. × 15 sec | 175° C. × 30 sec | 175° C. × 60 sec |
|---|---|---|---|---|---|---|---|
| $MgSO_4.7H_2O$ | $NaBO_2.4H_2O$ | $NaH_2PO_4$ | $KH_2PO_4$ | | | | |
| 95 | 5 | | | Dissolved | 24.2 | 13.7 | 10.2 |
| 71.25 | 3.75 | 25 | | Undissolved part left | 42.9 | 54.5 | 50.7 |
| 71.25 | 3.75 | | 25 | Undissolved part left | 31.1 | 47.3 | 41.4 |

When the temperature of the forming die is set to 175° C., the mold strength increases by adding sodium dihydrogen phosphate or potassium dihydrogen phosphate to the binder constituents. The sodium dihydrogen phosphate and potassium dihydrogen phosphate used are water soluble.

Prevention of Deterioration of Mold by Moisture Absorption

Table 16 shows the evaluations of strength and deterioration of the mold by moisture absorption when tricalcium phosphate, gypsum or cement is added as an auxiliary binder for preventing the mold deterioration by moisture absorption. Conditions of the evaluations are the same as those adopted for the evaluations shown in Table 2. To evaluate the mold deterioration by moisture absorption, the mold released from the forming die is left indoors for 24 hours before measuring the strength against compression.

When hydrated, tricalcium phosphate becomes hydroxyapatite and grows into rigid crystals. Tricalcium phosphate is a hydratable binder. Industrial tricalcium phosphate has already been hydrated in part and sometimes it is sold under the trade name of hydroxyapatite. Since tricalcium phosphate is insoluble in water, it is dispersed in the binder solution.

When any one of tricalcium phosphate, gypsum and cement is added, the mold strength measured immediately after the release from the forming die is slightly lower than the strength of the mold to which the auxiliary binder is not added, but the strength after 24 hours is not reduced very much. Even after 24 hours, hydratable tricalcium phosphate keeps higher mold strength than that obtained without the addition of tricalcium phosphate, thereby making up for the loss of the mold strength due to the absorption of moisture by the sulfate compounds.

(Preferred Examples and Comparative Examples)

Table 17 shows preferable examples 1–10 of various combinations of the sulfate compound, borate compound and phosphate compound and Table 18 shows comparative examples 1–4 in which the borate compound is not contained. The sum of the binder amount indicated in the tables is the addition amount of the binder per 100 parts by weight of the molding sand. Conditions of the evaluations of strength and the like are the same as those adopted for the evaluations shown in Table 2.

TABLE 16

| Binder composition (parts by weight) | | | | | State of binder solution | Strength against compression (98 kPa) 140° C. × 15 sec | After 24 h |
|---|---|---|---|---|---|---|---|
| $MgSO_4.7H_2O$ | $NaBO_2.4H_2O$ | $Ca_3(PO_4)_2$ | Gypsum | Cement | | | |
| 95 | 5 | | | | Dissolved | 30.7 | 10.5 |
| 90.25 | 3.75 | 5 | | | Undissolved part left | 29.8 | 23.6 |
| 90.25 | 3.75 | | 5 | | Undissolved part left | 28.0 | 20.5 |
| 90.25 | 3.75 | | | 5 | Undissolved part left | 26.7 | 17.3 |

TABLE 17

| Ex. | Binder composition (parts by weight) Sulfate compound $MgSO_4 \cdot 7H_2O$ | $Na_2SO_4 \cdot 10H_2O$ | $Al_2(SO_4)_3 \cdot 14–18H_2O$ | Phosphate compound $Ca_3(PO_4)_2$ | Borate compound $Na_2B_4O_7 \cdot 10H_2O$ | $NaBO_2 \cdot 4H_2O$ | $H_3BO_3$ | $Li_2B_4O_7 \cdot 5H_2O$ | The sum of binder amount (parts by weight) Solid part | Liquid part | Strength against compression (98 kpa) Temp: 140° C. 15 sec | 30 sec | 60 sec | Decomposition test after baking of 600° C. × 15 min. (sec) |
|---|---|---|---|---|---|---|---|---|---|---|---|---|---|---|
| 1 | 1.5 | 0.5 | | | 1.0 | | | | 3.0 | 1.2 | 24.3 | 30.5 | 40.6 | 6.5 |
| 2 | 2.3 | 0.8 | | | | | 1.0 | | 3.0 | 1.2 | 20.7 | 15.1 | 11.1 | 24.0 |
| 3 | 2.0 | 0.7 | | 0.15 | | 0.15 | | | 3.0 | 1.2 | 34.4 | 41.9 | 37.9 | 12.0 |
| 4 | 2.1 | 0.7 | | 0.15 | | | | 0.15 | 3.0 | 1.12 | 29.0 | 38.0 | 28.8 | 7.0 |
| 5 | 1.8 | 0.6 | | 0.15 | 0.3 | 0.15 | | | 3.0 | 1.0 | 34.4 | 39.9 | 42.4 | 10.5 |
| 6 | 1.2 | 0.6 | 0.6 | 0.15 | 0.3 | 0.15 | | | 3.0 | 1.0 | 27.0 | 34.5 | 26.8 | 9.0 |
| 7 | 1.5 | 0.5 | | | 1.1 | | | | 3.0 | 1.1 | 39.4 | 49.7 | 41.3 | 11.0 |
| 8 | 1.7 | 0.6 | | | 1.2 | | | | 3.5 | 1.0 | 44.0 | 45.3 | 51.5 | 11.0 |
| 9 | 1.9 | 0.6 | | | 1.3 | | | | 3.9 | 1.2 | 51.1 | 62.7 | 46.0 | 12.0 |
| 10 | 1.6 | 0.5 | | 0.09 | 1.2 | | | | 3.5 | 1.0 | 37.6 | 47.5 | 38.8 | 8.5 |

TABLE 18

| Com. Ex. | Binder composition (parts by weight) Sulfate compound $MgSO_4 \cdot 7H_2O$ | $Na_2SO_4 \cdot 10H_2O$ | $Al_2(SO_4)_3 \cdot 14–18H_2O$ | Phosphate compound $Ca_3(PO_4)_2$ | Borate compound $Na_2B_4O_7 \cdot 10H_2O$ | $NaBO_2 \cdot 4H_2O$ | $H_3BO_3$ | $Li_2B_4O_7 \cdot 5H_2O$ | The sum of binder amount (parts by weight) Solid part | Liquid part | Strength against compression (98 kPa) Temp: 140° C. 15 sec | 30 sec | 60 sec | Decomposition test after baking of 600° C. × 15 min. (sec) |
|---|---|---|---|---|---|---|---|---|---|---|---|---|---|---|
| 1 | 2.3 | 0.8 | | | | | | | 3.0 | 1.2 | 0 | 5.5 | 10.6 | 4.0 |
| 2 | 1.5 | 0.8 | 0.8 | | | | | | 3.0 | 1.2 | 0 | 6.1 | 12.2 | 4.0 |
| 3 | 2.1 | 0.7 | | 0.15 | | | | | 3.0 | 1.2 | 0 | 4.8 | 11.5 | 4.0 |
| 4 | 1.4 | 0.7 | 0.7 | 0.15 | | | | | 3.0 | 1.2 | 0 | 5.9 | 13.3 | 4.0 |

Examples 1–10 give high strengths to the molds after the 15-second air purging. Except Example 2, high mold strengths are also obtained after the 30- and 60-second air purging. Further, the results of the decomposition test are also excellent. On the other hand, Comparative Examples 1–4 does not give strength to the molds after the 15-second air purging. The strengths given after the 30- and 60-second air purging are still low. Thus, the results indicate that the borate compound effectively contributes to the fast curing and strengthening of the mold.

The binders of Examples were used to form molds with a warm shot molding machine. As a result, molds of various weights (several hundred g to a dozen or so kg) were obtained at the forming die temperature of 110° C. to 170° C. In particular, an innermold (about 3 kg) used for forming a water jacket in an engine cylinder block was cured within 25 to 40 seconds, allowing reduction of a molding cycle of the molding machine to 1 minute or less.

In the same manner, the binders of Comparative Examples were used to form the innermold for the water jacket (about 3 kg) with the warm shot molding machine, but the innermold required 60 to 90 seconds to be cured. The molding cycle was about 1.5 to 2 minutes, resulting in low productivity.

What is claimed is:

1. A casting mold which is molded by heating mulled sand including a mixture of refractory molding sand particles, an inorganic water soluble binder and water, wherein the inorganic water soluble binder contains a sulfate compound and a borate compound, at least part of the sulfate compound retains water of crystallization therein after the heating and the borate compound is once fused by the heating and then cured.

2. A casting mold according to claim 1, wherein the borate compound is one or a combination of two or more of sodium tetraborate, sodium metaborate, dipotassium tetraborate, ammonium borate, boric acid, magnesium borate, lithium tetraborate, aluminum borate and manganese borate.

3. A casting mold according to claim 2, wherein the content of the borate compound in the inorganic water soluble binder is 75 mass % or less.

4. A casting mold according to claim 1, wherein the sulfate compound is at least one of magnesium sulfate, aluminum sulfate and sodium sulfate and decomposed at a temperature of 750° C. or higher.

5. A casting mold according to claim 1, wherein the inorganic water soluble binder further contains at least one of sodium dihydrogen phosphate, potassium dihydrogen phosphate, tricalcium phosphate and magnesium chloride.

6. A method for manufacturing a casting mold using mulled sand including a mixture of an inorganic water soluble binder containing a sulfate compound and a borate compound, water and refractory molding sand particles, the method comprising the steps of:

filling a forming die with the mulled sand; and heating the mulled sand in the forming die in such a manner that at least part of the sulfate compound retains water of crystallization therein and the borate compound is fused.

7. A method according to claim 6, wherein the forming die is kept at a specified temperature and filled with the mulled sand to heat the mulled sand by heat transferred from the forming die.

* * * * *